US008887503B2

(12) United States Patent
Sonwane et al.

(10) Patent No.: US 8,887,503 B2
(45) Date of Patent: Nov. 18, 2014

(54) RECUPERATIVE SUPERCRITICAL CARBON DIOXIDE CYCLE

(75) Inventors: Chandrashekhar Sonwane, Canoga Park, CA (US); Kenneth M. Sprouse, Canoga Park, CA (US); Ganesan Subbaraman, Canoga Park, CA (US); George M. O'Connor, Canoga Park, CA (US); Gregory A. Johnson, Canoga Park, CA (US)

(73) Assignee: Aerojet Rocketdyne of DE, Inc, Canoga Park, CA (US)

( * ) Notice: Subject to any disclaimer, the term of this patent is extended or adjusted under 35 U.S.C. 154(b) by 51 days.

(21) Appl. No.: 13/323,874

(22) Filed: Dec. 13, 2011

(65) Prior Publication Data

US 2013/0145759 A1 Jun. 13, 2013

(51) Int. Cl.
*F01K 25/08* (2006.01)
*F01K 25/10* (2006.01)

(52) U.S. Cl.
CPC ..... *F01K 25/103* (2013.01)
USPC ..... 60/651; 60/671

(58) Field of Classification Search
CPC ..... F01K 25/103
USPC ..... 60/39.52, 39.17, 39.04, 643–684; 290/1 R
See application file for complete search history.

(56) References Cited

U.S. PATENT DOCUMENTS

| | | | | |
|---|---|---|---|---|
| 3,583,156 | A * | 6/1971 | Schabert | 376/391 |
| 4,498,289 | A * | 2/1985 | Osgerby | 60/39.52 |
| 6,674,830 | B2 * | 1/2004 | Kato et al. | 376/391 |
| 7,131,259 | B2 | 11/2006 | Rollins, III | |
| 7,685,820 | B2 * | 3/2010 | Litwin et al. | 60/641.11 |
| 8,490,397 | B2 * | 7/2013 | Lehar | 60/651 |
| 8,616,001 | B2 * | 12/2013 | Held et al. | 60/646 |
| 8,783,034 | B2 * | 7/2014 | Held | 60/651 |
| 2009/0272113 | A1 * | 11/2009 | Takeuchi et al. | 60/643 |
| 2011/0113780 | A1 | 5/2011 | Lehar | |
| 2011/0179799 | A1 | 7/2011 | Allam et al. | |
| 2012/0216536 | A1 * | 8/2012 | Ma et al. | 60/641.8 |
| 2013/0033044 | A1 * | 2/2013 | Wright et al. | 290/1 R |

FOREIGN PATENT DOCUMENTS

WO 95/02115 1/1995

OTHER PUBLICATIONS

Bengston, "Fundamentals of Heat Exchanger Theory and Design", Oct. 6, 2010, brighthubengineering.com.*

* cited by examiner

*Primary Examiner* — Thomas Denion
*Assistant Examiner* — Laert Dounis
(74) *Attorney, Agent, or Firm* — Joel G Landau

(57) ABSTRACT

A power plant includes a closed loop, supercritical carbon dioxide system (CLS-$CO_2$ system). The CLS-$CO_2$ system includes a turbine-generator and a high temperature recuperator (HTR) that is arranged to receive expanded carbon dioxide from the turbine-generator. The HTR includes a plurality of heat exchangers that define respective heat exchange areas. At least two of the heat exchangers have different heat exchange areas.

5 Claims, 3 Drawing Sheets

RECUPERATIVE SUPERCRITICAL CARBON DIOXIDE CYCLE

STATEMENT REGARDING FEDERALLY SPONSORED RESEARCH OR DEVELOPMENT

This invention was made with government support under contract number DE-AC07-03SF22307 awarded by the Department of Energy. The government has certain rights in the invention.

BACKGROUND

This disclosure relates to a supercritical carbon dioxide thermodynamic cycle in a power plant. Thermodynamic cycles are known and used to convert heat into work. For example, a working fluid receives heat from a heat source and is then expanded over a turbine that is coupled to a generator to produce electricity. The expanded working fluid is then condensed or compressed before recirculating to the heat source for another thermodynamic cycle.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
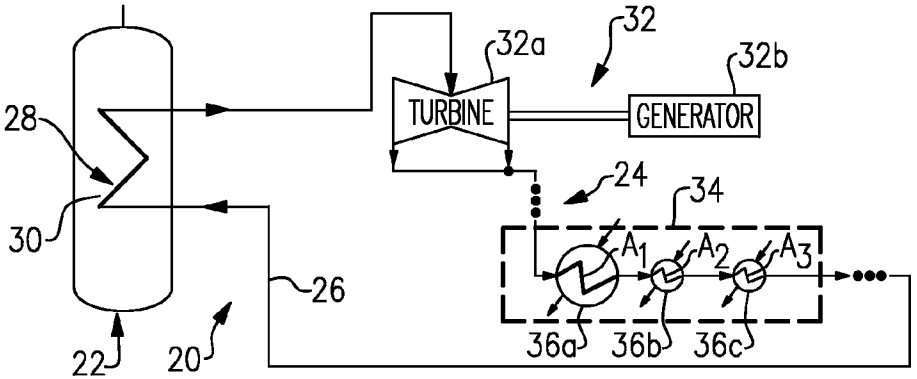
FIG. 1 shows a portion of an example power plant that utilizes a high temperature recuperator having a plurality of heat exchangers.

FIG. 1 illustrates selected portions of a power plant 20 that utilizes a thermodynamic cycle to generate electric power. Power plants, such as those based on supercritical carbon dioxide for generating electricity, have difficulty competing with other types of power plants due to higher costs and lower efficiencies. As will be described in more detail below, the example power plant 20 is based on a supercritical carbon dioxide-based thermodynamic cycle and is designed for enhanced efficiency at lower costs.

As shown, the power plant 20 includes a heat source 22 that is operable to generate heat. The heat source 22 is not limited to any particular kind of heat source and can be an entrained-bed gasification reactor, nuclear reactor, solar heating system or fossil fuel combustor/reactor, for example.

The heat source 22 serves to provide heat to a closed loop, supercritical carbon dioxide system 24. The term "closed loop" as used herein refers to a system that does not rely on matter exchange outside of the system and thus, the carbon dioxide-based working fluid (hereafter "working fluid") that is transported through the system 24 is contained within the system 24. In one example, the working fluid is composed substantially of carbon dioxide. In other examples, the working fluid includes xenon, helium or other fluid mixed with carbon dioxide.

The system 24 generally includes lines 26 or conduits that serve to transport the working fluid through the system 24. As indicated by the breaks in the line 26, the system 24 can include additional components which are not shown in this example. A section 28 of the line 26 is arranged to receive the heat from the heat source 22 to heat the working fluid. In this example, the heat source 22 is a reactor vessel for the combustion of raw materials to generate the heat. A fluidized bed 30 is provided in a portion of the vessel, and the section 28 is located at least partially within the fluidized bed 30.

With regard to flow of the working fluid, the system 24 also includes a turbine-generator 32 downstream from the heat source 22. The turbine-generator 32 includes a turbine section 32*a* that is coupled to drive a generator section 32*b* to generate electricity.

The system 24 further includes a high temperature recuperator (HTR) that is arranged downstream from the section 28 and the turbine-generator 32. As shown, the HTR 34 includes a plurality of heat exchangers 36*a*, 36*b*, and 36*c*. Although only three heat exchangers are shown, it is to be understood that two heat exchangers or additional heat exchangers can be used in other examples. The heat exchangers 36*a*, 36*b* and 36*c* may be printed circuit, shell/tube, stamped plate, plate/fin, formed plate or other type of heat exchanger, for example.

The heat exchangers 36*a*, 36*b* and 36*c* define respective heat exchange areas, represented as $A_1$, $A_2$ and $A_3$, respectively, and at least two of the heat exchangers have different heat exchange areas. The heat exchange area is the wall surface area between the two streams exchanging heat in each of the heat exchangers 36*a*, 36*b* and 36*c*.

In the illustrated example, the plurality of heat exchangers 36*a*, 36*b* and 36*c* are arranged consecutively in series with regard to the flow of the working fluid received from the turbine-generator 32. In one example, the heat exchange area $A_1$ of the first one of the heat exchangers 36*a* in the series is less than the heat exchanger area $A_2$ and/or $A_3$ of the other heat exchangers 36*b* and 36*c* in the series. For example, the heat exchange area $A_1$ is less than each of the heat exchange areas $A_2$ and $A_3$. In another example, $A_1$ is less than $A_2$, and $A_2$ is less than $A_3$. In another embodiment, $A_1$ is greater than $A_2$, and $A_1$ is less than $A_3$. In one example where only two heat exchangers 36*a* and 36*b* are used, and $A_1$ is less than $A_2$.

In further embodiments, the heat exchange areas $A_1$, $A_2$ and/or $A_3$ are selected such that a ratio of the heat exchange area $A_1$ to the heat exchange area of $A_2$ and/or $A_3$ is greater than 1:1. In a further example, the ratio is equal to or greater than 1:3. In another example, the ratio is equal to or greater than 1:4.

The selected areas $A_1$, $A_2$ and $A_3$ and given ratio reduce system cost and improve efficiency. The temperature of the working fluid received into the HTR 34 from the turbine-generator 32 is extremely high. Carbon dioxide is generally not an efficient heat transfer fluid. Thus, if a single heat exchanger were to be used, the log mean temperature difference is kept low to exchange the required amount of heat, which requires a high heat exchange area and specialized, high temperature materials (e.g., superalloys) to handle the high temperatures. By dividing the heat duty over the plurality of heat exchangers 36*a*, 36*b* and 36*c* with heat exchange areas $A_1$, $A_2$ and $A_3$ as described above, a single, large and expensive heat exchanger with specialized material is eliminated.

In one example, the first heat exchanger 36*a* in the series can be made of specialized materials, while the other heat exchangers 36*b* and 36*c* can be made of standard, lower cost materials, such as stainless steel. Thus, dividing the heat duty among the plurality of heat exchangers 36*a*, 36*b* and 36*c* reduces the overall levelized cost of electricity in terms of cents per kilo-watt-hour of the power plant 20 and makes it more competitive with other types of power plants.

In operation, the working fluid flows through the described components of the system 24. The thermodynamic cycle of the working fluid can be represented in a known manner by pressure versus enthalpy and/or temperature versus entropy diagrams. In the cycle, the working fluid in section 28 within the heat source 22 is heated to a supercritical state. The turbine-generator 32 receives the supercritical working fluid from section 28. The supercritical working fluid expands through the turbine section 32*a* to drive the generator 32*b* and generate electricity. The expanded working fluid from the turbine section 32*a* is later received into the HTR 34.

As shown, the heat exchangers 36*a*, 36*b* and 36*c* are arranged in series such that the working fluid is first received through heat exchanger 36*a*, then heat exchanger 36*b* and finally, heat exchanger 36*c*. In this example, the heat exchangers 36*a*, 36*b* and 36*c* are consecutively arranged such that the output of the heat exchanger 36*a* is received directly into exchanger 36*b* and the output of heat exchanger 36*b* as received directly into exchanger 36*c* without any other components in the series.

After the third heat exchanger 36*c*, the working fluid may be transferred through additional components within the system 24 before returning to section 28 within the heat source 22 for another thermodynamic cycle.

Figure 2:
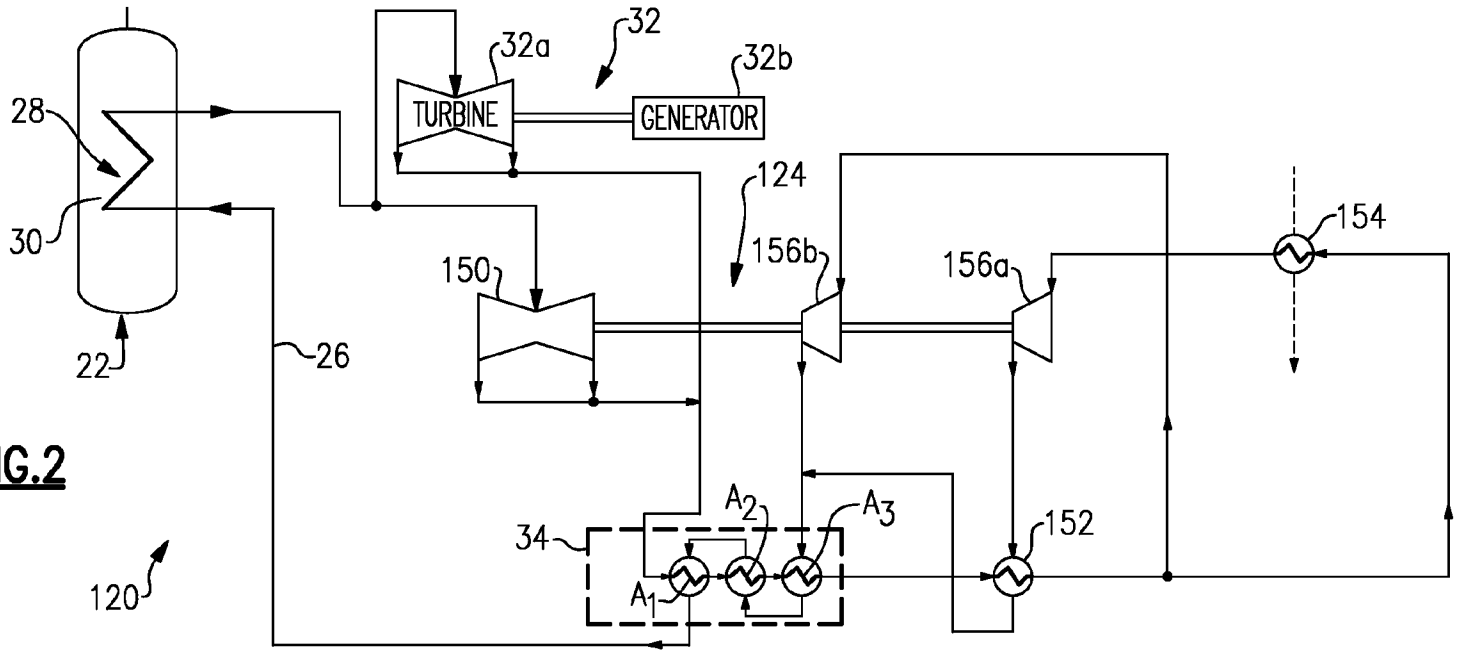
FIG. 2 illustrates another example power plant that also utilizes a high temperature recuperator with a plurality of heat exchangers.

FIG. 2 illustrates another example power plant 120. In this disclosure, like reference numerals designate like elements where appropriate and reference numerals with the addition of one-hundred or multiples thereof designate modified elements that are understood incorporate the same features and benefits of the corresponding elements. In this example, the power plant 120 also includes the HTR 34 as in FIG. 1. However, additional components in the power plant 120 are shown and will now be described.

The power plant 120 includes a closed loop, super critical carbon dioxide system 124. In addition to the section 28 heated by the heat source 22, and the turbine-generator 32, the system 124 additionally includes at least one secondary turbine 150 that is arranged to receive as an input a portion of the working fluid from section 28 that is heated by the heat source 22. That is, the line 26 divides downstream from section 28 such that a portion of the working fluid flows to the turbine section 32*a* and a remaining portion flows to the at least one secondary turbine 150. The remaining portion that flows through the secondary turbine 150 recombines with the portion that flows through the turbine section 32*a* before flowing into the HTR 34. The HTR 34 is arranged as described above.

The system 124 also includes a low temperature recuperator (LTR) 152 that is arranged downstream from the HTR 34 to receive as a first input working fluid from the HTR 34. As shown in this example, the LTR 152 is directly downstream from the HTR 34 such that there are no additional components in between. The LTR 152 includes one or more relatively small heat exchangers (in comparison to the heat exchangers 36*a*, 36*b* and/or 36*c*) for additionally cooling the working fluid.

A cooler 154 is arranged downstream from the LTR 152 to receive a portion of the working fluid from the LTR 152. That is, after the LTR 152, the line 26 divides such that a portion of the working fluid flows to the cooler 154 and another portion flows elsewhere as will be described below. In the illustrated example, the cooler 154 is water cooled heat exchanger.

The system 124 further includes a first compressor 156*a* and a second compressor 156*b*. The two compressors 156*a* and 156*b* are coupled to be driven by the secondary turbine 150. The first compressor 156*a* is arranged to receive the portion of the working fluid from the cooler 154. The second compressor 156*b* is arranged to receive the remaining portion of the working fluid from the LTR 152.

The LTR 152 is also arranged to receive as a second input for heat exchange with its first input from the HTR 34 the working fluid from the first compressor 156*a*. The HTR 34 is arranged to receive as a second input for heat exchange with its first input from the turbine section 32*a* and the secondary turbine 150 the working fluid from the second compressor 156*b* and the second input working fluid from the LTR 152. In this example, the working fluid then returns to the section 28 within the heat source 22 for another thermodynamic cycle.

Figure 3:
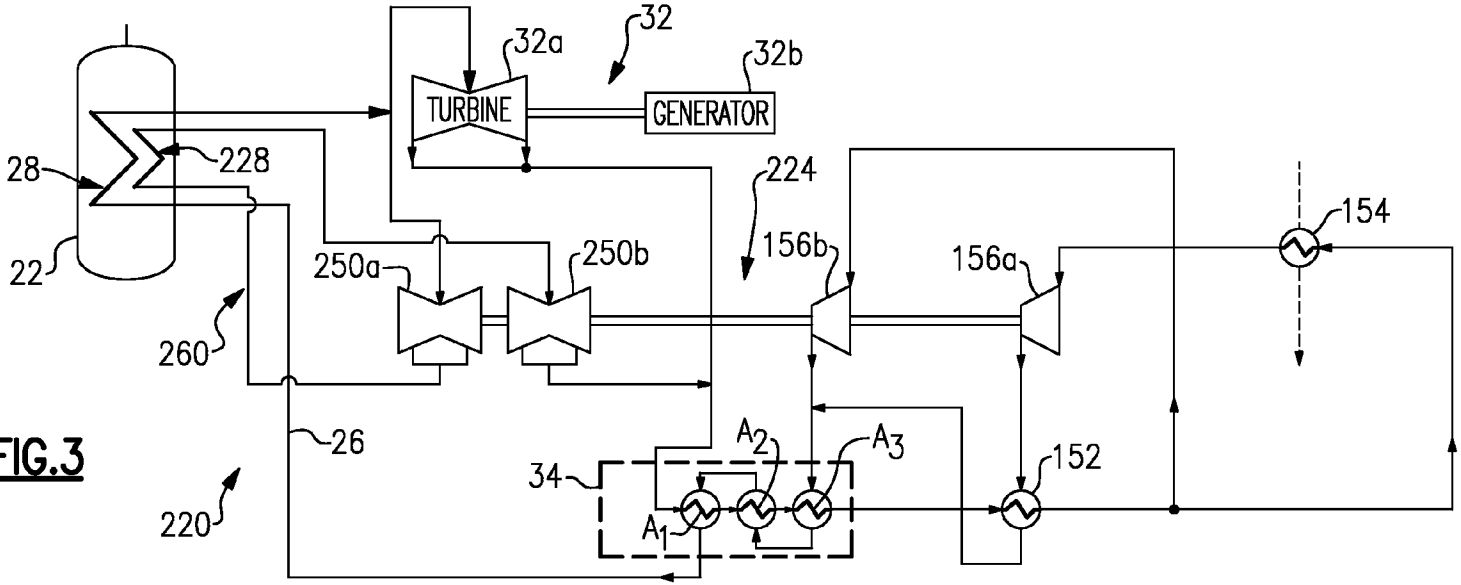
FIG. 3 illustrates another example power plant that is similar to the power plant shown in FIG. 2 but includes a reheat loop.

FIG. 3 shows another example power plant 220 that is somewhat similar to the power plant 120 shown in FIG. 2 but includes a reheat loop 260. In this example, the working fluid from the section 28 divides such that a portion flows to the turbine section 32*a* and a remaining portion flows to a high temperature turbine 250*a* that is coupled to drive first and second compressors 156*a* and 156*b*. The working fluid expands through the high pressure turbine 250*a* and then flows through the reheat loop 260 to another section 228 within the fluidized bed 30 of the heat source 22 for reheating of the working fluid.

A low pressure turbine 250*b* is also coupled to drive the first and second compressors 156*a* and 156*b*. The low pressure turbine 250*b* is arranged to receive the working fluid heated from the reheat section 228 and discharge the expanded working fluid to the HTR 34. The reheat loop 260 absorbs additional thermal energy from the heat source 22 by reheating the working fluid and using the reheated working fluid to drive the turbines 250*a* and 250*b* to in turn drive the compressors 156*a* and 156*b*.

Figure 4:
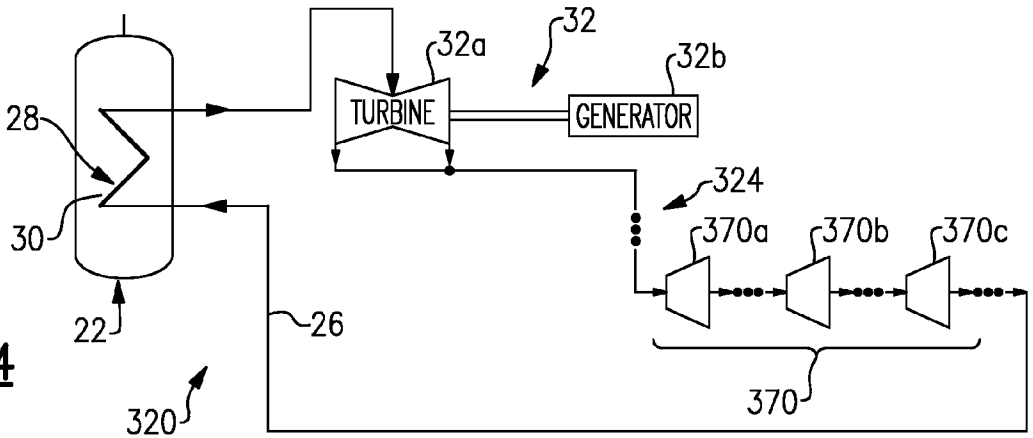
FIG. 4 illustrates another example power plant that utilizes a turbine that is sized to expand supercritical carbon dioxide to a state with supercritical temperature but non-supercritical pressure and a plurality of compressors that are arranged to receive the non-supercritical state carbon dioxide.

FIG. 4 illustrates another example power plant 320 with a closed loop, supercritical carbon dioxide system 324. In this example, the system 324 also includes the section 28 that is arranged to receive the heat from the heat source 22, and the turbine-generator 32 for expanding the working fluid received from section 28. The system 324 includes a plurality of compressors 370 that are arranged to receive working fluid from the turbine-generator 32. As shown, the plurality of compressors 370 includes three compressors, 370*a*, 370*b* and 370*c* that are arranged in series, however, it is to be understood that several of the compressors 370 may alternatively be arranged in parallel such that the outputs are then fed to the third compressor before returning to section 28 for another thermodynamic cycle.

In this example, the working fluid is heated by the heat source 22 to a supercritical state. The turbine section 32*a* is sized to expand the supercritical carbon dioxide to a non-supercritical state. As an example, the turbine section 32*a* expands the supercritical carbon dioxide to a non-supercritical gaseous state. The plurality of compressors 370 receives the non-supercritical state carbon dioxide from the turbine section 32*a*. The plurality of compressors 370*a* are sized to compress the non-supercritical carbon dioxide back into a supercritical state or near-supercritical state prior to return to the section 28 for another thermodynamic cycle. As indicated by the broken lines in line 26, other components may be used in between each of the plurality of compressors 370 and before or after the compressors 370.

Figure 5:
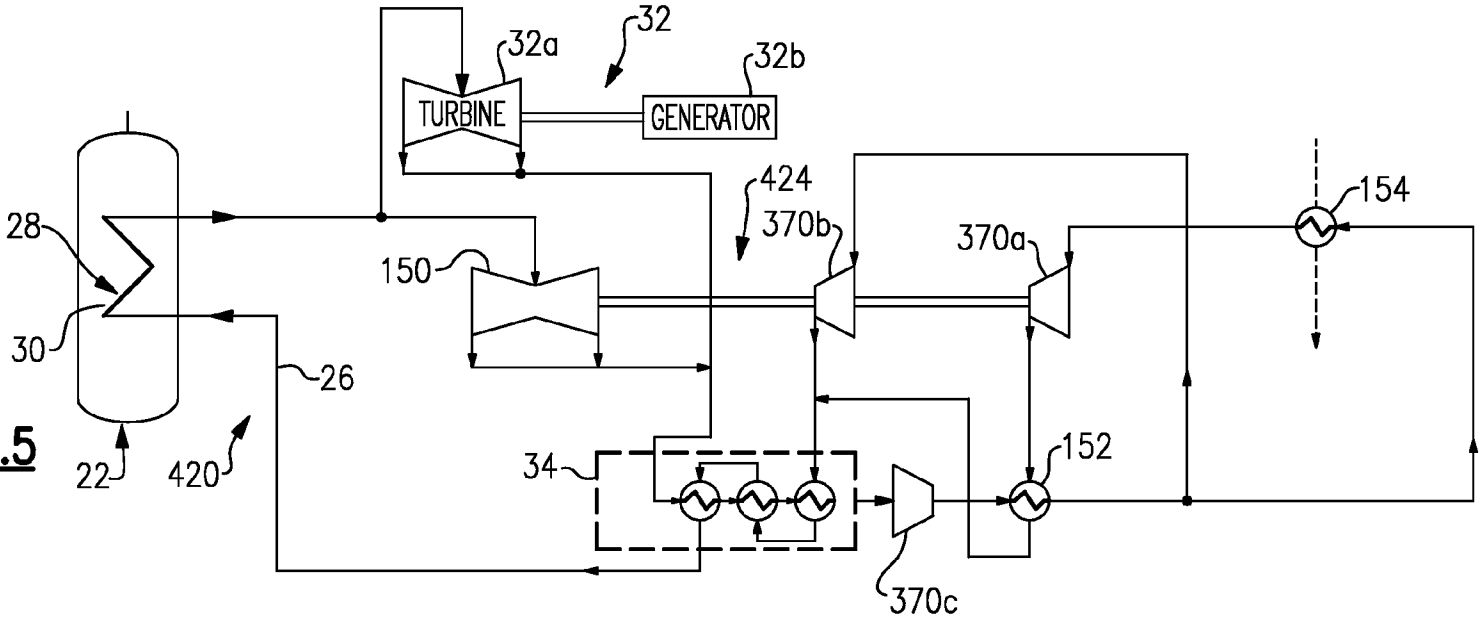
FIG. 5 is similar to the power plant shown in FIG. 2 but additionally includes another compressor.

Referring to FIG. 5, another example power plant 420 is shown. The power plant 420 is somewhat similar to the power plant 120 shown in FIG. 2 with the exception that the first compressor 156*a* is labeled as first compressor 370*a*, the second compressor 156*b* is labeled as second compressor 370*b* and the third compressor 370*c* is located downstream from the HTR 34 and upstream from the LTR 152. Thus, the two compressors 370*a* and 370*b* are arranged in parallel and ultimately receive the discharge from the third compressor 370*c*, which compresses the working from the non-supercritical state to the supercritical state or near supercritical state before return to section 28 for another thermodynamic cycle.

Figure 6:
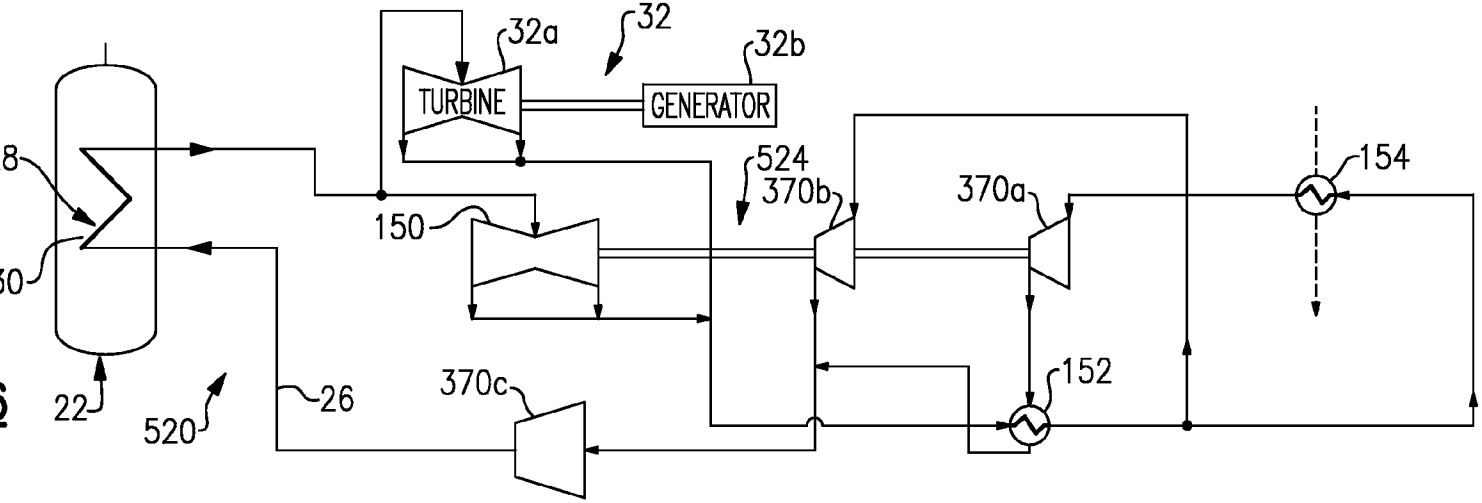
FIG. 6 shows another power plant that is similar to the example shown in FIG. 5 but excludes the high temperature recuperator.

FIG. 6 shows another example power plant 520 that is somewhat similar to the power plant 420 shown in FIG. 5. However, in this example, the closed loop, supercritical carbon dioxide system 524 excludes the HTR 34 that is present in the system 424 of FIG. 5. Thus, the working fluid from the turbine section 32*a* and the secondary turbine 150 is received directly into the LTR 152 rather than into the HTR 34. In order to exclude the HTR 34, the turbine section 32*a*, the secondary turbine 150 or both are sized larger than the turbine section 32*a*, turbine section 150 or both of the example in FIG. 5 in order to provide greater expansion of the working fluid sufficient to lower the temperature of the working fluid to a temperature that is suitable for a direct input into the LTR 152, which is formed of non-specialized materials (e.g., superalloys), such as stainless steel.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A power plant comprising:

a dosed loop, carbon dioxide-based system ($CO_2$ system chiding, according to flow sequence within the $CO_2$ system:

a turbine-generator arranged to receive as an input a portion of a flow of supercritical carbon dioxide and discharge an output that is subcritical or supercritical, at least one secondary turbine arranged to receive as an input a remaining portion of the flow carbon dioxide, a high temperature recuperator (HTR) arranged to receive as a first input expanded subcritical or supercritical carbon dioxide from the turbine-generator and the at least one secondary turbine, the HTR including a plurality of heat exchangers that define respective heat exchange areas, wherein at least two of the heat exchangers have different heat exchange areas, a low temperature recuperator (LTR) arranged to receive as a first input carbon dioxide from the HTR, a cooler arranged to receive a portion of the carbon dioxide from the LTR, a first compressor coupled to be driven by the secondary turbine and arranged to receive the portion of the carbon dioxide from the cooler, a second compressor coupled to be driven by the secondary turbine and arranged to receive a remaining portion of the carbon dioxide from the LTR, and wherein the LTR is also arranged to receive as a second input for heat exchange with its first input the carbon dioxide from the first compressor and the HTR is arranged to receive as a second input for heat exchange with its first input the carbon dioxide from the second compressor and from the second input of the LTR before return of the carbon dioxide to the section heated by a heat source.

2. The power plant as recited in claim 1, wherein the plurality of heat exchangers are arranged consecutively in series with regard to the flow of the expanded carbon dioxide received from the turbine-generator and the at least one secondary turbine.

3. The power plant as recited in claim 1, wherein the at least one secondary turbine includes a high pressure turbine arranged to receive as an input the remaining portion of the supercritical carbon dioxide from the section heated by the heat source and discharge expanded carbon dioxide to a different, reheat section also arranged to receive the heat from the heat source.

4. The power plant as recited in claim 3, wherein the at least one secondary turbine includes a low pressure turbine arranged to receive the carbon dioxide from the reheat section and discharge expanded carbon dioxide to the HTR.

5. A power plant comprising:

a heat source operable to generate heat; and a closed loop, supercritical carbon dioxide system (CLS-$CO_2$ system) including a section arranged to receive the heat from the heat source to heat the supercritical carbon dioxide, the CLS-$CO_2$ system including:

a turbine-generator arranged to expand supercritical carbon dioxide received from the section heated by the heat source, the turbine being sized to expand the supercritical carbon dioxide to a non-supercritical state, a plurality of compressors arranged to receive the non-supercritical state carbon dioxide from the turbine, the plurality of compressors being sized to compress the non-supercritical carbon dioxide to a supercritical state prior to return to the section heated by the heat source, a low temperature recuperator (LTR) arranged to receive as a first input carbon dioxide from the turbine-generator, and a cooler arranged to receive a portion of the carbon dioxide from the LTR, and the plurality of compressors includes a first compressor arranged to receive the portion of the carbon dioxide from the cooler, a second compressor arranged to receive a remaining portion of the carbon dioxide from the LTR and a third compressor arranged to receive carbon dioxide from the first compressor and the second compressor.

* * * * *